US009220961B1

(12) United States Patent
Kim

(10) Patent No.: US 9,220,961 B1
(45) Date of Patent: Dec. 29, 2015

(54) GOLF TEE

(71) Applicant: Jay W. Kim, La Mirada, CA (US)

(72) Inventor: Jay W. Kim, La Mirada, CA (US)

( * ) Notice: Subject to any disclaimer, the term of this patent is extended or adjusted under 35 U.S.C. 154(b) by 0 days.

(21) Appl. No.: 14/521,794

(22) Filed: Oct. 23, 2014

(51) Int. Cl.

| | |
|---|---|
| ***A63B 57/10*** | (2015.01) |
| ***A63B 57/19*** | (2015.01) |
| ***A63B 57/00*** | (2015.01) |
| ***A63B 71/06*** | (2006.01) |

(52) U.S. Cl.
CPC ..... *A63B 57/0018* (2013.01); *A63B 57/10* (2015.10); *A63B 57/19* (2015.10); *A63B 71/06* (2013.01); *A63B 2071/0694* (2013.01)

(58) Field of Classification Search
CPC ..... A63B 57/0018; A63B 71/06; A63B 2071/0694
USPC ..... 473/387–403; D21/717, 718
See application file for complete search history.

(56) References Cited

U.S. PATENT DOCUMENTS

| | | | | | |
|---|---|---|---|---|---|
| 230,585 | A | * | 7/1880 | Soule | 411/455 |
| 1,623,782 | A | * | 4/1927 | Dent et al. | 473/392 |
| 1,671,813 | A | * | 5/1928 | Clarke | 473/403 |
| 1,761,532 | A | * | 6/1930 | Morris | 473/218 |
| 1,936,625 | A | * | 11/1933 | Goldman | 473/398 |
| 2,018,146 | A | * | 10/1935 | Penny | 473/402 |
| 2,082,811 | A | * | 6/1937 | Thorup | 473/402 |
| D252,109 | S | * | 6/1979 | Clugage | D21/718 |
| 4,192,504 | A | * | 3/1980 | Clugage | 473/257 |
| 4,951,945 | A | * | 8/1990 | Gamble | 473/400 |
| 5,149,088 | A | * | 9/1992 | O'Hara | 473/396 |
| 6,004,228 | A | * | 12/1999 | Adam | 473/403 |
| 6,010,413 | A | * | 1/2000 | Pan-Chung | 473/402 |
| D431,849 | S | * | 10/2000 | MacDonald | D21/718 |
| 6,280,350 | B1 | * | 8/2001 | Chung | 473/387 |
| D559,926 | S | * | 1/2008 | Wood | D21/718 |
| D583,428 | S | * | 12/2008 | Worth et al. | D21/718 |
| D583,429 | S | * | 12/2008 | Worth et al. | D21/718 |
| 7,717,811 | B1 | * | 5/2010 | Merullo | 473/387 |
| D621,456 | S | * | 8/2010 | Cathro | D21/718 |
| D656,212 | S | * | 3/2012 | Cherrie et al. | D21/793 |
| 8,403,776 | B1 | * | 3/2013 | Gruenwald | 473/387 |
| 8,439,771 | B1 | * | 5/2013 | Fleming | 473/397 |
| 2002/0013186 | A1 | * | 1/2002 | Webb | 473/399 |
| 2007/0004538 | A1 | * | 1/2007 | Lim | 473/387 |
| 2007/0270246 | A1 | * | 11/2007 | Salmon | 473/397 |

* cited by examiner

*Primary Examiner* — Steven Wong
(74) *Attorney, Agent, or Firm* — John K. Park; Park Law Firm

(57) ABSTRACT

A golf tee is provided, including a head portion, a neck portion, a stem portion, and a tip portion. The head portion is provided on a top of the golf tee and having a right-left symmetry. The neck portion is extended from the head portion and having a the right-left symmetry. The stem portion is extended from the neck portion and having a broken right-left symmetry. The tip portion is extended from the stem portion and configured for being pushed into a ground. The stem portion provides top-down and right-left aerodynamic unbalances to the golf tee, such that the golf tee rotates about a middle portion much more rather than flies away when the golf tee receives an external impact.

9 Claims, 6 Drawing Sheets

– Prior Art –

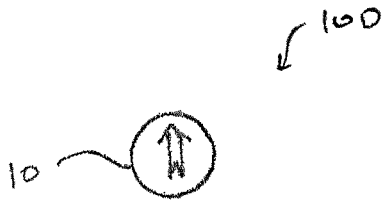
Fig. 10
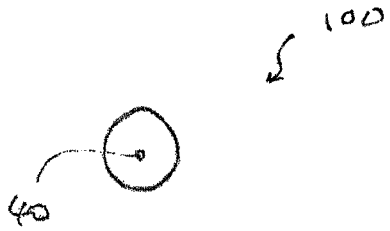
Fig. 11
Fig. 12
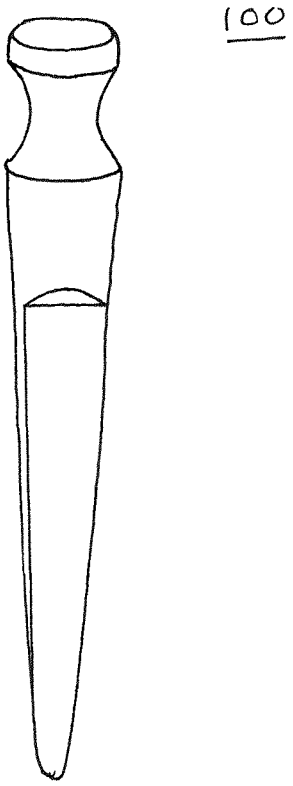
Fig. 13
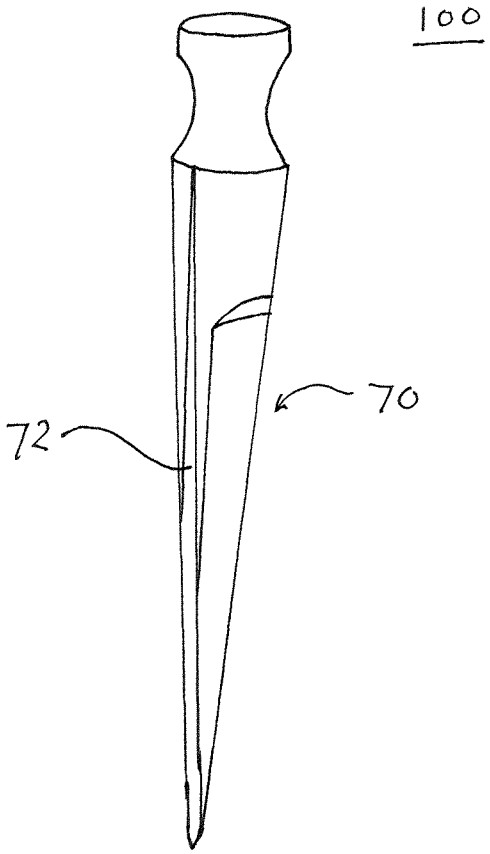

GOLF TEE

BACKGROUND OF THE INVENTION

The present invention relates to a golf tee. More particularly, this invention relates to a golf tee, which is sturdy and very convenient to use.

With the advent of a golf as sports for everyone, the frequency of usage of golf tees increased drastically. Several dozens of golf tees may be needed for a rounding, for example.

Therefore, it would be great to have golf tees that are sturdy and convenient to use in many ways.

Conventional golf tees have a lot of problems. They break easily and have to be discarded everywhere. They fly away from the swing position in random directions and get lost. In any cases, a huge number of golf tees could not be retrieved or reused for the above reasons, becoming a great burden to the environment of the golf course.

Accordingly, a need for a sturdy golf tee has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide a golf tee.

The golf tee comprises a head portion, a neck portion, a stem portion, and a tip portion.

The head portion is provided on a top of the golf tee and having a right-left symmetry.

The neck portion is extended from the head portion and having a the right-left symmetry.

The stem portion is extended from the neck portion and having a broken right-left symmetry.

The tip portion is extended from the stem portion and configured for being pushed into a ground.

The stem portion is configured to provide top-down and right-left aerodynamic unbalances to the golf tee, such that the golf tee rotates about a middle portion thereof much more rather than flies away when the golf tee receives an external impact.

The head portion may have a shape of cone.

The neck portion may have a shape of cylinder.

The stem portion may have a shape of cylinder in general, and one substantial half-side of the stem portion may be cut out.

The cut-out portion of the stem portion may comprise a tilted surface and a vertical surface.

Each of the tilted surface and the vertical surface may be flat.

The neck portion may comprise a circular groove provided around a portion of the neck portion.

The golf tee may have a front-rear symmetry so as to have a weight balance with respect to a front-rear direction.

The golf tee may further comprise an arrow mark on the top surface of the head portion thereof, which points to a direction in which a user of the golf tee puts the golf tee into the ground.

The arrow mark may point perpendicularly to a right-left direction of the right-left aerodynamic unbalance.

The neck portion, the stem portion, and the tip portion have a general shape of a single cone.

The golf tee may further comprise a front flat surface and a rear flat surface, each of which being provided from the neck portion to the tip portion.

The advantages of the present invention are: (1) the golf tee is strong against an external impact and does not break easily; and (2) the golf tee according to the invention rotates more than translates in a direction of the impact, and therefore it doesn't fly away from the user.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 10 is a top view of the golf tee of FIG. 6;

FIG. 11 is a bottom view of the golf tee of FIG. 6;

FIG. 12 is a right perspective view of a golf tee according to still another embodiment of the invention; and FIG. 13 is a right perspective view of a golf tee according to still another embodiment of the invention.

DETAILED DESCRIPTION EMBODIMENTS OF THE INVENTION

Referring to the figures, the embodiments of the invention are described in detail.

The present invention contrives to solve the disadvantages of the prior art.

Figure 1:
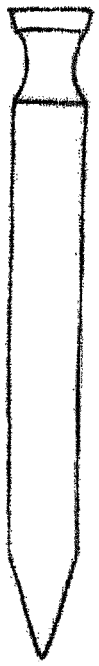
FIG. 1 is a perspective view showing a conventional golf tee.

FIG. 1 shows a conventional golf tee.

FIGS. 2-5 shows golf tees according to various embodiments of the invention.

FIGS. 6-11 shows a golf tee according to another embodiment of the invention.

FIG. 12-13 show golf tees according to still another embodiments of the invention.

A golf tee 100 comprises a head portion 10 and a stem portion.

A golf tee according to an embodiment of the invention has following inventive features.

(1) The stem portion is formed to be unbalanced or asymmetrical or narrow. Therefore, the tee may receive some shock along with the golf ball, but the golf tee does not fly far away from the original position due to aerodynamic property of the tee.

(2) For the same reason as the above, the golf tee is not broken easily.

(3) The pointed tip is sharp enough to penetrate the ground smoothly and easily.

The head portion may be same as prior arts.

However, the stem portion is provided narrow, flat, or pointed, such that the shock applied to the head portion of the tee is not transferred down to the lower portion of the stem. Thus, the stem portion does not fly away and is not broken easily.

As shown in FIG. 1, a regular golf tee has a shape of circular symmetry with respect to an axis through the vertical center line thereof. Also, the top part (the head portion+upper part of the stem portion) and the remaining bottom part (the lower part of the stem portion) are sort of balanced with respect to a point between those two parts.

The inventive features are introduced to the bottom part, breaking the top-bottom balance.

Some portion of the bottom part may be carved out from one side or both sides thereof. Of course, there may be tens of different ways to introduce some unbalance features (top vs bottom, right vs left with respect to the central axis).

There are three basic ways of applying the inventive features to the conventional golf tee as follows.

Figure 2:
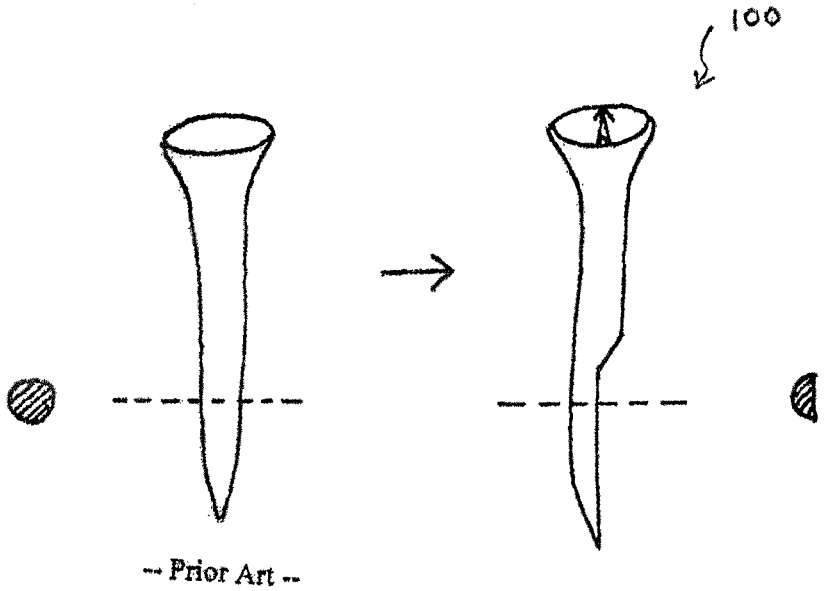
FIG. 2 is a perspective view showing a golf tee according to an embodiment of the invention.

As shown in FIG. 2, a vertical chunk of one side of the bottom part may be cut out. Now, the golf tee in the right side of FIG. 2 has an unbalance between the right and left sides of the bottom part of the golf tee.

Figure 3:
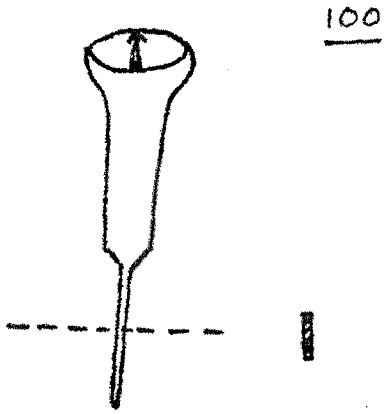
FIG. 3 is a perspective view showing a golf tee according to another embodiment of the invention.

As shown in FIG. 3, the same shape of chunk is carved out from two opposite sides, leaving a flat portion which has a original width in a direction perpendicular to the surface of the paper.

Figure 4:
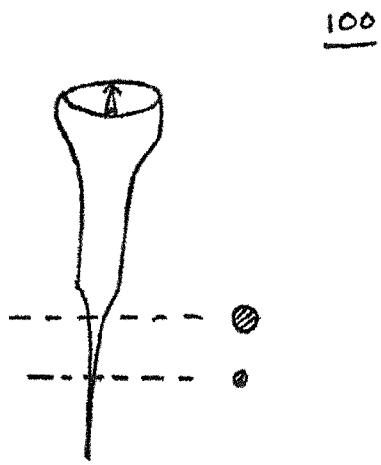
FIG. 4 is a perspective view showing a golf tee according to still another embodiment of the invention.

As shown in FIG. 4, some of the bottom part of the golf tee are removed or carved out all around the central axis, leaving a pointed or needle shape.

The golf tee in FIG. 2 has a broken symmetry in top vs bottom and also another broken symmetry in right vs left of the central axis.

The golf tee in FIG. 3 has a broken symmetry in top vs bottom and also another broken symmetry in a direction perpendicular to the central axis.

The golf tee in FIG. 4 has a broken symmetry in top vs bottom only.

In FIGS. 1-4, cross-sectional views are also shown.

In certain embodiments of the invention, the above three features may be combined in a golf tee.

Figure 5:
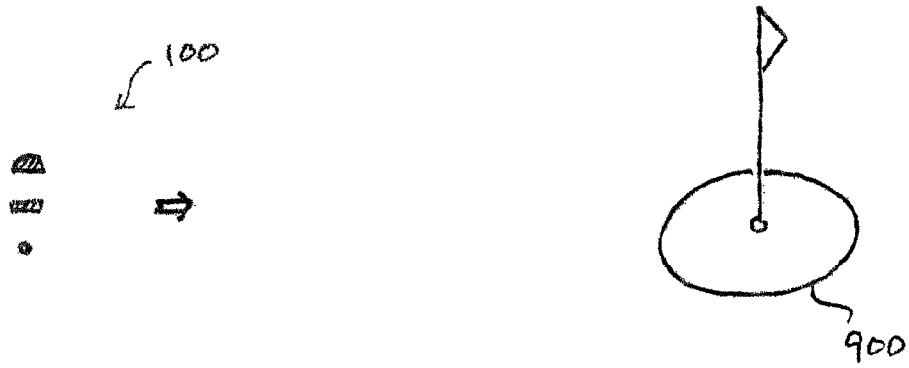
FIG. 5 is a perspective view showing a direction of the golf tee toward a green.
Figure 6:
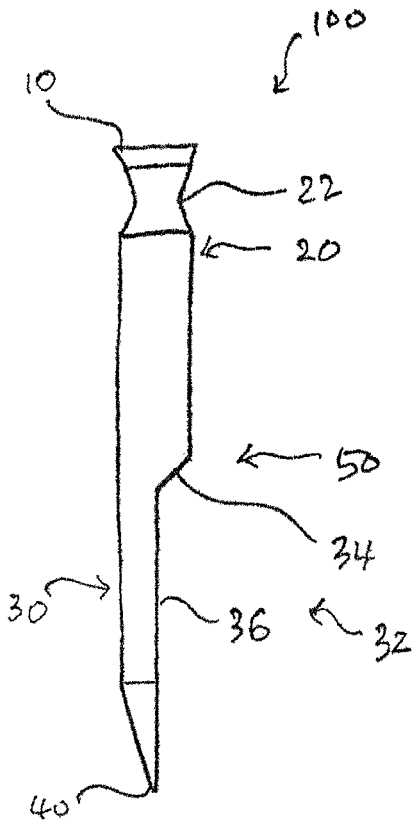
FIG. 6 is a front view showing a golf tee according to still another embodiment of the invention.
Figure 7:
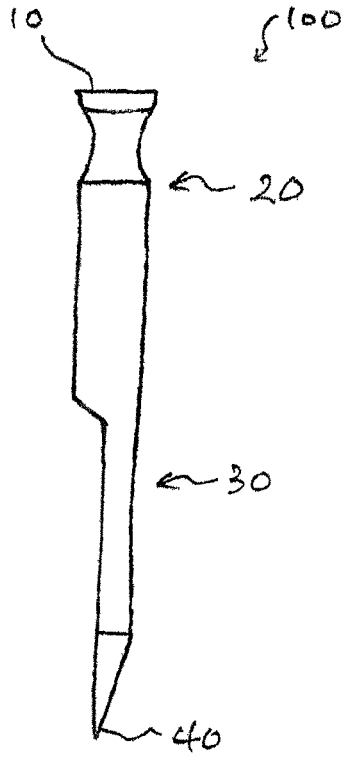
FIG. 7 is a rear view of the golf tee of FIG. 6.
Figure 8:
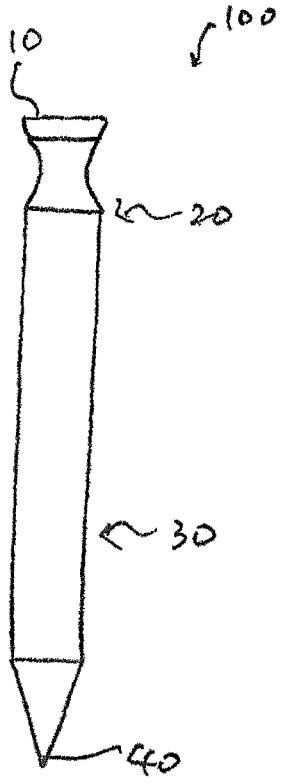
FIG. 8 is a left side view of the golf tee of FIG. 6.
Figure 9:
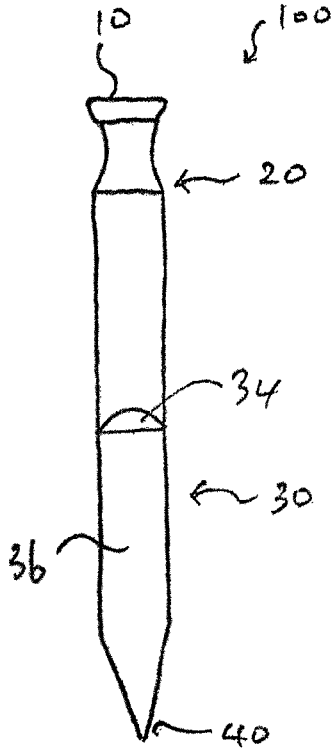
FIG. 9 is a right side vied of the golf tee of FIG. 6.

Furthermore, the golf tee may include an arrow mark on the top surface of the head portion thereof, which points to a direction in which a user of the golf tee puts his or her golf tee on the ground as shown in FIG. 5.

The golf tee must poke the ground such that the arrow mark points in the direction where the user wants to fly his or her golf ball as shown in FIG. 5.

In certain embodiments of the invention, the cross-section of the bottom part of the golf tee may be wedge-shaped. In such case, the sharp edge would point toward the green or where the ball is going to fly.

The golf tee in FIG. 2 may be made of plastic or wood, and the golf tees in FIGS. 3 and 4 may be made of plastic only. Of course, the material for golf tee does not have to be limited to wood and/plastic. Any material that can impart a strength enough to the golf tee may be used instead of wood or plastic.

Also, the inventor would like to emphasize that the tees according to the invention tend to stay where they were even after the user's tee shot finished, not mentioning that if plucked out and flied they still can be found very close to the original position.

The trajectory or the tee may depend on many factors such as the golfer's swing, condition of grass, hardness of soil below the grass, dampness of air, etc. Still, the tees according to the invention produce the above results persistently thanks to the inventive features thereof.

Another aspect of the invention provides a golf tee 100, comprising a head portion 10, a neck portion 20, a stem portion 30, and a tip portion 40.

The head portion 10 is provided on a top of the golf tee 100 and having a right-left symmetry.

The neck portion 20 is extended from the head portion 10 and having a the right-left symmetry.

The stem portion 30 is extended from the neck portion 20 and having a broken right-left symmetry.

The tip portion 40 is extended from the stem portion 30 and configured for being pushed into a ground.

The stem portion 30 is configured to provide top-down and right-left aerodynamic unbalances to the golf tee 100, such that the golf tee 100 rotates about a middle portion 50 thereof much more rather than flies away when the golf tee 100 receives an external impact.

The head portion 10 may have a shape of cone.

The neck portion 20 may have a shape of cylinder.

The stem portion 30 may have a shape of cylinder in general, and one substantial half-side of the stem portion may be cut out.

The cut-out portion 32 of the stem portion 30 may comprise a tilted surface 34 and a vertical surface 36.

Each of the tilted surface 34 and the vertical surface 36 may be flat.

The neck portion 20 may comprise a circular groove 22 provided around a portion of the neck portion 20.

The golf tee 100 may have a front-rear symmetry so as to have a weight balance with respect to a front-rear direction.

The golf tee 100 may further comprise an arrow mark 60 on the top surface of the head portion 10 thereof, which points to a direction in which a user of the golf tee 100 puts the golf tee 100 into the ground.

The arrow mark 60 may point perpendicularly to a right-left direction of the right-left aerodynamic unbalance. That is, the user or the golfer puts the golf tee 100 into the ground such that the vertical surface 36 of the cut-out portion 32 is to be parallel to the arrow mark 60.

In the illustrated embodiment, the direction of the arrow mark 60 may be reversed for the same result. That is, the front and rear directions as well as the right and left directions can be reversed. Also, the arrow mark 60 may be bi-directional.

In certain embodiments of the invention, the neck portion 20, the stem portion 30, and the tip portion 40 have a general shape of a single cone as shown in FIG. 12. The golf tee 100 may further comprise a front flat surface 70 and a rear flat surface 72, each of which being provided from the neck portion 20 to the tip portion 40 as shown in FIG. 13.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A golf tee comprising:

a head portion provided on a top of the golf tee and having a right-left symmetry;

a neck portion extended from the head portion and having a right-left symmetry;

a stem portion extended from the neck portion and having a broken right-left symmetry; and a tip portion extended from the stem portion and configured for being pushed into a ground, wherein the stem portion is configured to provide top-down and right-left aerodynamic unbalances to the golf tee, such that the golf tee rotates about a middle portion thereof much more rather than flies away when the golf tee receives an external impact wherein the stem portion has a shape of cylinder in general, and wherein a lower portion of one substantial half-side of the stem portion is cut out, the cut out extending through the tip portion to the end of the tee.

2. The golf tee of claim 1, wherein the head portion has a shape of cone.

3. The golf tee of claim 2, wherein the neck portion has a shape of cylinder.

4. The golf tee of claim 1, wherein the cut-out portion of the stem portion comprises a tilted surface and a vertical surface.

5. The golf tee of claim 4, wherein each of the tilted surface and the vertical surface is flat.

6. The golf tee of claim 1, wherein the neck portion comprises a circular groove provided around a portion of the neck portion.

7. The golf tee of claim 1, wherein the golf tee has a front-rear symmetry so as to have a weight balance with respect to a front-rear direction.

8. The golf tee of claim 1, further comprising an arrow mark on the top surface of the head portion thereof, which points to a direction in which a user of the golf tee puts the golf tee into the ground.

9. The golf tee of claim 8, wherein the arrow mark points perpendicularly to a right-left direction of the right-left aerodynamic unbalance.

* * * * *